US012735957B1

(12) United States Patent
Asthana et al.

(10) Patent No.: US 12,735,957 B1
(45) Date of Patent: Sep. 15, 2026

(54) OPERATING DOWNHOLE WELLBORE VALVES

(71) Applicant: Saudi Arabian Oil Company, Dhahran (SA)

(72) Inventors: Pranay Asthana, Dhahran (SA); Ahmed Y. Bukhamseen, Dhahran (SA); Muhammad Arsalan, Dhahran (SA); Abubaker Saeed, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/230,437

(22) Filed: Jun. 6, 2025

(51) Int. Cl.
*E21B 34/14* (2006.01)
*E21B 23/08* (2006.01)

(52) U.S. Cl.
CPC ..... *E21B 34/142* (2020.05); *E21B 23/08* (2013.01); *E21B 2200/06* (2020.05)

(58) Field of Classification Search
CPC ..... E21B 23/08; E21B 34/14; E21B 34/142
See application file for complete search history.

(56) References Cited

U.S. PATENT DOCUMENTS 6,364,017 B1 * 4/2002 Stout ..... E21B 23/06 166/278
7,150,318 B2 12/2006 Freeman
8,276,674 B2 * 10/2012 Lopez de Cardenas ..... E21B 43/14 166/334.4
8,757,252 B2 6/2014 Franklin et al.
8,863,852 B2 10/2014 Clausen
8,981,957 B2 3/2015 Gano et al.
9,394,752 B2 * 7/2016 Fleming ..... E21B 34/14
9,650,851 B2 5/2017 Whitsitt et al.
9,683,419 B2 * 6/2017 Coon ..... E21B 47/09
9,695,656 B2 * 7/2017 Webster ..... E21B 23/00
9,732,573 B2 8/2017 Adam
9,752,411 B2 9/2017 Adam
9,759,040 B2 * 9/2017 Nguyen ..... E21B 43/14
10,100,612 B2 * 10/2018 Lisowski ..... E21B 34/102
10,301,910 B2 * 5/2019 Whitsitt ..... E21B 34/142
10,301,927 B2 * 5/2019 Sallwasser ..... E21B 47/092
10,316,645 B2 * 6/2019 Ingraham ..... E21B 47/09
10,370,917 B2 * 8/2019 Coon ..... E21B 23/08
(Continued)

FOREIGN PATENT DOCUMENTS

CN 120830480 A * 10/2025 ..... E21B 41/00
EP 2960427 A1 12/2015
(Continued)

*Primary Examiner* — Jennifer H Gay
(74) *Attorney, Agent, or Firm* — Fish & Richardson P.C.

(57) ABSTRACT

An autonomous downhole tool includes a housing including at least one modular sleeve that rides on the housing and is configured to adjust to conceal or expose a shift latch that includes a latch profile. The latch profile is shaped to interface with a shift sleeve profile of a shift sleeve of a downhole valve installed in a wellbore tubular that extends through a wellbore formed from a terranean surface into a subterranean formation. The autonomous downhole tool includes an autonomous carrier coupled with the housing and including an actuator module configured to generate a shift force to adjust the shift sleeve on the downhole valve with the shift latch engaged with the shift sleeve through mechanical engagement of the latch profile with the shift sleeve profile.

24 Claims, 12 Drawing Sheets

(56) References Cited

U.S. PATENT DOCUMENTS 10,704,383 B2 7/2020 Andreychuk et al.
11,268,335 B2 3/2022 Vick, Jr. et al.
11,746,612 B2 * 9/2023 Watkins ..... E21B 34/142 166/255.2
12,006,793 B2 * 6/2024 Watkins ..... E21B 43/14
12,104,460 B1 * 10/2024 Song ..... E21B 43/2607
12,352,147 B2 * 7/2025 Payne ..... E21B 34/14
2011/0056692 A1 * 3/2011 Lopez de Cardenas ..... E21B 43/08 166/305.1
2013/0112435 A1 * 5/2013 Fleming ..... E21B 34/14 166/318
2013/0206402 A1 * 8/2013 Coon ..... E21B 43/14 166/305.1
2014/0345876 A1 * 11/2014 Coon ..... E21B 34/06 166/373
2015/0060056 A1 3/2015 Kumaran et al.
2015/0176369 A1 * 6/2015 Nguyen ..... E21B 23/02 166/308.1
2015/0361747 A1 * 12/2015 Lafferty ..... E21B 23/08 166/373
2016/0032670 A1 * 2/2016 Webster ..... E21B 23/00 166/243
2016/0084075 A1 * 3/2016 Ingraham ..... E21B 23/01 166/53
2016/0108722 A1 * 4/2016 Whitsitt ..... E21B 34/142 166/254.1
2016/0333661 A1 * 11/2016 Sallwasser ..... E21B 34/142
2017/0175488 A1 * 6/2017 Lisowski ..... E21B 43/08
2017/0254165 A1 * 9/2017 Coon ..... E21B 23/08
2021/0238988 A1 * 8/2021 Watkins ..... E21B 34/142
2022/0145749 A1 * 5/2022 Watkins ..... E21B 47/138
2023/0167733 A1 6/2023 Zeghlache
2024/0133280 A1 * 4/2024 Payne ..... E21B 34/142
2024/0229628 A9 * 7/2024 Payne ..... E21B 34/14
2024/0279993 A1 * 8/2024 Fripp ..... E21B 23/001
2025/0327373 A1 * 10/2025 Arabskyy ..... E21B 47/09

FOREIGN PATENT DOCUMENTS

WO WO-2012045165 A1 * 4/2012 ..... E21B 23/08
WO WO-2022236083 A1 * 11/2022 ..... E21B 34/142

* cited by examiner

OPERATING DOWNHOLE WELLBORE VALVES

TECHNICAL FIELD

This disclosure relates to operating downhole wellbore valves and, more particularly, operating downhole wellbore valves with an autonomous downhole tool.

BACKGROUND

Existing methods for contingency shifting of a sliding sleeve in flow control devices, primarily downhole valves such as inflow control devices (ICDs) and inflow control valves (ICVs) are largely based on manual mechanical intervention using coil tubing, e-line, or wireline conveyance and using specialized shifting tools connected to the bottom hole assembly (BHA). These sleeves are operated through intervention operations typically for the purpose of water control or shutoff in ICDs to close zones, or to move a stuck ICV when the primary hydraulic or electric surface control is compromised. Typically, surface-controlled shifting is only done through tethered means, such as hydraulic lines, electric lines with or without wireless short hops, or rigless intervention using coil tubing, e-line and wireline. This results in high costs and downtime for the operation. The reliability of the shifting job itself is low because of the depths at which this is conducted typically as a blind lock-and-pull operation. Indeed, most shift mechanisms are designed to shift uphole to close the ports in an ICD/ICV, which is aligned with the use of long strings of intervention conveyance equipment like coil tubing, e-line, and wireline.

Furthermore, positive indication of a successful shifting operation is only possible by doing a post job production logging test (PLT) or having the well site infrastructure equipped with advanced multiphase metering (MPFM), which read a change in water cut after the operation. However, MPFM are usually only equipped when there are multi-lateral wells or smart ICV completions, whereas ICDs are largely run in open hole single lateral wells.

Another challenge faced in operations is to confirm with credibility where the unwanted fluids are actually coming in from the vicinity of the zone which was being controlled by the now-shifted-close ICD or ICV. In some cases, the tubulars in vicinity of the shifted device are damaged due to environmental corrosion or mechanical failure.

SUMMARY

In an example implementation, an autonomous downhole tool includes a housing including at least one modular sleeve that rides on the housing and is configured to adjust to conceal or expose a shift latch that includes a latch profile. The latch profile is shaped to interface with a shift sleeve profile of a shift sleeve of a downhole valve installed in a wellbore tubular that extends through a wellbore formed from a terranean surface into a subterranean formation. The autonomous downhole tool includes an autonomous carrier coupled with the housing and including an actuator module configured to generate a shift force to adjust the shift sleeve on the downhole valve with the shift latch engaged with the shift sleeve through mechanical engagement of the latch profile with the shift sleeve profile.

In an aspect combinable with the example implementation, the housing includes an untethered housing configured to move through the wellbore exclusive of a downhole conveyance that extends through the wellbore from the terranean surface to the housing.

In another aspect combinable one, some, or all of the previous aspects, the at least one modular sleeve includes a first modular sleeve that rides on the housing and is configured to adjust to conceal or expose the shift latch; and a second modular sleeve that rides on the housing and is configured to adjust to conceal or expose a tubing seal from the housing, the tubing seal configured to engage the wellbore tubular to maintain the housing at a stationary location in the wellbore.

In another aspect combinable one, some, or all of the previous aspects, the tubing seal is configured to generate a pressure differential on the housing when engaged with the wellbore tubular to generate the shift force.

In another aspect combinable one, some, or all of the previous aspects, the autonomous carrier includes a sensor module configured to detect and confirm the adjustment of the shift sleeve on the downhole valve.

In another aspect combinable one, some, or all of the previous aspects, the actuator module includes one or more pre-programmed wellbore locations, each of the one or more pre-programmed wellbore locations including a unique downhole valve installed in the wellbore tubular.

In another aspect combinable one, some, or all of the previous aspects, the wellbore tubular includes production tubing, and the downhole valve includes an inflow control device or inflow control valve.

In another example implementation, a method of operating a downhole valve includes running an autonomous downhole tool into a wellbore tubular that extends through a wellbore formed from a terranean surface into a subterranean formation. The autonomous downhole tool includes a housing including at least one modular sleeve that rides on the housing; and an autonomous carrier coupled with the housing and including an actuator module. The method includes moving the autonomous downhole tool to a particular location in the wellbore tubular at which a downhole valve is installed; exposing a shift latch with the at least one modular sleeve, the shift latch including a latch profile shaped to interface with a shift sleeve profile of a shift sleeve of the downhole valve; engaging the latch profile of the shift latch with the shift sleeve profile of the shift sleeve; and generating a shift force to adjust the shift sleeve on the downhole valve with the shift latch engaged with the shift sleeve.

In an aspect combinable with the example implementation, moving the autonomous downhole tool includes moving the housing through the wellbore exclusive of a downhole conveyance that extends through the wellbore from the terranean surface to the housing.

In another aspect combinable one, some, or all of the previous aspects, the at least one modular sleeve includes a first modular sleeve and a second modular sleeve, and the method includes adjusting the first module sleeve to expose the shift latch; adjusting the second modular sleeve to expose a tubing seal from the housing; and engaging the wellbore tubular with the tubing seal to maintain the housing at a stationary location in the wellbore.

Another aspect combinable one, some, or all of the previous aspects includes generating a pressure differential on the housing in response to engaging the tubing seal with the wellbore tubular to generate the shift force.

Another aspect combinable one, some, or all of the previous aspects includes detecting and confirming the adjustment of the shift sleeve on the downhole valve with a sensor module of the autonomous downhole tool.

Another aspect combinable one, some, or all of the previous aspects includes moving the autonomous downhole tool to one or more pre-programmed wellbore locations subsequent to detecting and confirming the adjustment of the shift sleeve on the downhole valve with the sensor module of the autonomous downhole tool.

In another aspect combinable one, some, or all of the previous aspects, the wellbore tubular includes production tubing, and the downhole valve includes an inflow control device or inflow control valve.

In another example implementation, an untethered autonomous downhole tool includes an untethered housing movable through a wellbore exclusive of a downhole conveyance, the wellbore formed from a terranean surface into a subterranean formation and including a wellbore tubular in which a downhole valve is installed; and an autonomous carrier coupled with the housing and including a transmitter configured to generate a wireless signal to an activator tag of the downhole valve. The wireless signal includes a command to the activator tag to activate a shift sleeve of the downhole valve to adjust the downhole valve between an open position and a closed position.

In an aspect combinable with the example implementation, the wireless signal includes a radio frequency signal or a Bluetooth® signal.

Another aspect combinable one, some, or all of the previous aspects includes a sensor module configured to detect and confirm the activation of the shift sleeve on the downhole valve.

Another aspect combinable one, some, or all of the previous aspects includes an actuator module that includes one or more pre-programmed wellbore locations, each of the one or more pre-programmed wellbore locations including a unique downhole valve installed in the wellbore tubular.

In another aspect combinable one, some, or all of the previous aspects, the wellbore tubular includes production tubing, and the downhole valve includes an inflow control device or inflow control valve.

In another example implementation, a method of operating a downhole valve includes running an untethered autonomous downhole tool into a wellbore tubular that extends through a wellbore formed from a terranean surface into a subterranean formation exclusive of a downhole conveyance. The untethered autonomous downhole tool includes an untethered housing; and an autonomous carrier coupled with the housing and including a transmitter. The method includes moving the untethered autonomous downhole tool to a particular location in the wellbore tubular at which a downhole valve is installed; generating a wireless signal from the autonomous carrier to an activator tag of the downhole valve, the wireless signal including a command to the activator tag; and in response to the command, activating a shift sleeve of the downhole valve to adjust the downhole valve between an open position and a closed position.

In an aspect combinable with the example implementation, the wireless signal includes a radio frequency signal or a Bluetooth® signal.

Another aspect combinable one, some, or all of the previous aspects includes detecting and confirming the activation of the shift sleeve on the downhole valve with a sensor module of the autonomous carrier.

Another aspect combinable one, some, or all of the previous aspects includes moving the untethered autonomous downhole tool to one or more pre-programmed wellbore locations subsequent to detecting and confirming the adjustment of the shift sleeve on the downhole valve with the sensor module of the autonomous carrier.

In another aspect combinable one, some, or all of the previous aspects, the wellbore tubular includes production tubing, and the downhole valve includes an inflow control device or inflow control valve.

Implementations of systems and methods for operating a downhole wellbore valve according to the present disclosure may include one or more of the following features. For example, implementations according to the present disclosure can help avoid time and costs associated with rigless intervention rental equipment including coil tubing, E-line, wireline, and associated specialized shifting tools for downhole valves. As another example, implementations according to the present disclosure can provide positive confirmation of a shifting operation by recording information during operation downhole and download/processing at retrieval. Further, implementations according to the present disclosure can provide credibility confirmation of source of unwanted fluids ingress through probing a vicinity zone of the target downhole valve that was shifted with local positive indication. Also, implementations according to the present disclosure can provide multiple shift operations on various valves in different bores and laterals in the same run by using a unique addressing scheme and, in some aspects, using a universal enhanced shift profile with in situ force generation system. In a further example, implementations according to the present disclosure can allow for automated two way shifting of a downhole valve as needed in a well scenario. Also, implementations according to the present disclosure can provide increased reliability of the operations at deep and ultra-deep sections of the wells, particularly complex multi-lateral well configurations, where the current technologies have primarily a blind operation.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1:
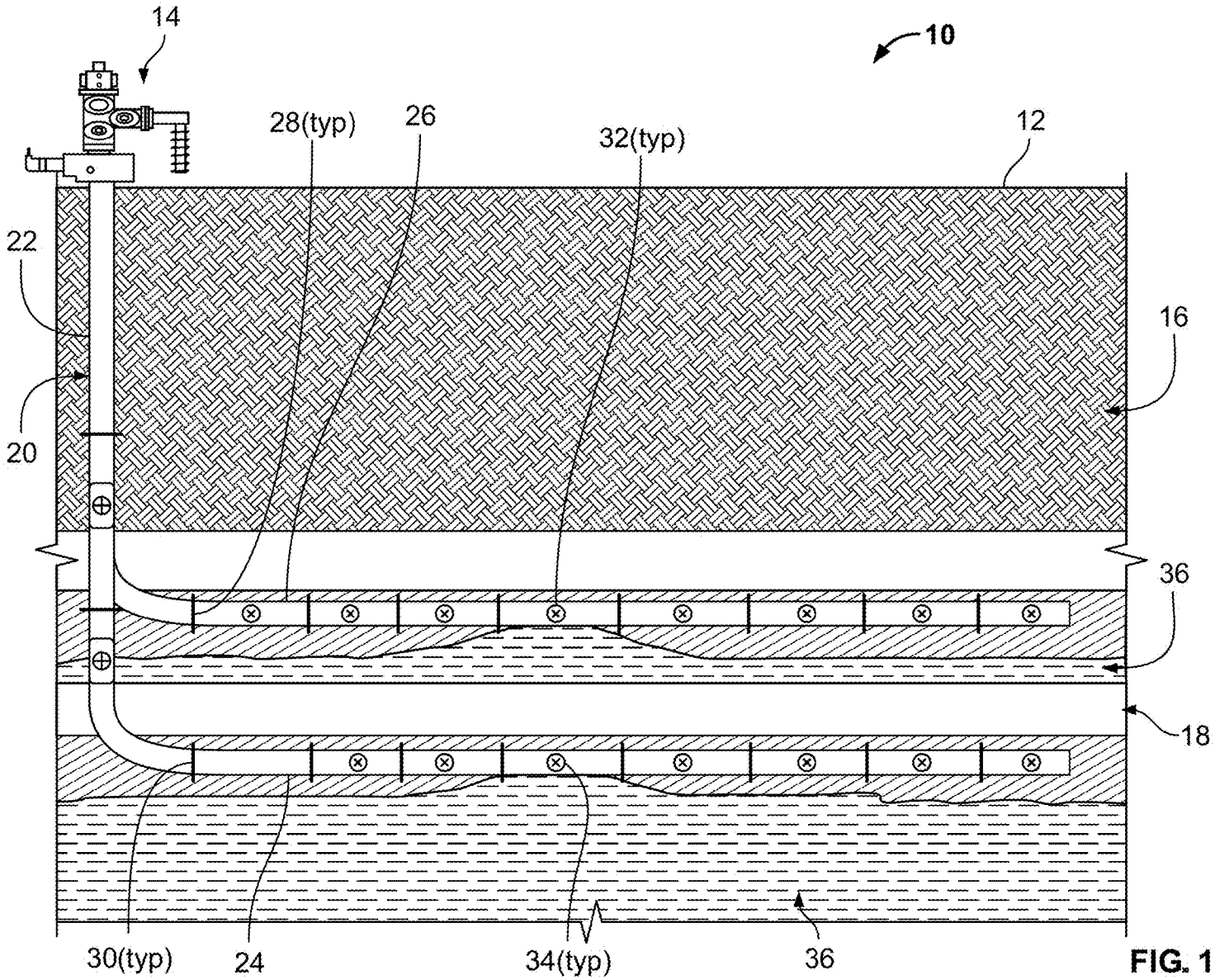
FIG. 1 is a schematic diagram of an example wellbore system that includes one or more adjustable downhole valves according to the present disclosure.

The present disclosure describes implementations of systems and methods for operating downhole wellbore valves and, more particularly, operating downhole wellbore valves with an autonomous downhole tool. In example aspects, an autonomous downhole tool can operate to adjust one or more downhole valves, such as one or more ICDs or ICVs. The adjustment can include opening a closed downhole valve, closing an open downhole valve, or otherwise adjusting a percentage opening of the valve in order to control a flow of wellbore fluid (for example, oil, gas, mixed phase fluid, water, or otherwise) into the wellbore through the valve(s). In some aspects, an autonomous downhole tool can operate to complete a process completely free of any command generated at a terranean surface. In alternative aspects, an autonomous downhole tool can operate to complete a process according to one or more commands generated at a terranean surface that guide the autonomous downhole tool to perform some but not all of the steps of the process.

Example aspects of an autonomous downhole tool according to the present disclosure can be untethered tools. For example, an untethered autonomous downhole tool can move bidirectionally through a wellbore (and through fluid in a wellbore) without a physical connection to a downhole conveyance, such as a tubular workstring, coiled tubing, wireline, e-line, or other form of cable or string. In some aspects, the untethered autonomous downhole tool can move bidirectionally through the wellbore through self-motive propulsion, hydraulic flow of the wellbore fluid, pressure gradients within the wellbore fluid, or a combination thereof. While many example implementations of an autonomous downhole tool according to the present disclosure are untethered tools, alternative implementations can be tethered autonomous downhole tools that are physically connected in the wellbore with a downhole conveyance. Thus, descriptions of actions or capabilities of an untethered autonomous downhole tool according to the present disclosure are also applicable to tethered autonomous downhole tools of the present disclosure.

In example aspects, autonomous downhole tools according to the present disclosure can adjust a downhole valve (for example, ICD or ICV) through a mechanical sleeve shifting operation, in which the autonomous downhole tool physically adjusts a sliding sleeve on the downhole valve between closed and open positions. In other example aspects, autonomous downhole tools according to the present disclosure can adjust a downhole valve (for example, ICD or ICV) through a wireless sleeve shift operation, in which the autonomous downhole tool wirelessly adjusts (for example, with a unique, addressable wireless communication between the autonomous downhole tool and the downhole valve) a sliding sleeve on the downhole valve between closed and open positions. In a closed position, wellbore fluid (for example, reservoir fluid from a subterranean formation) does not enter the wellbore from the reservoir through the downhole valve. In an open position, wellbore fluid does enter the wellbore from the reservoir through the downhole valve. In some aspects, an autonomous downhole tool according to the present disclosure can be the same or similar to untethered downhole tools described in U.S. patent application Ser. No. 18/910,946, the contents of which are incorporated by reference herein.

Example aspects of an autonomous downhole tool according to the present disclosure can perform one, some, or all of the following functions. For example, an autonomous downhole tool can operate to create a shift force downhole to adjust a sliding sleeve on a downhole valve. As another example, an autonomous downhole tool can operate to actuate and trigger the shift force and convey/carry the actuator system to target downhole locations. Also, an autonomous downhole tool can operate to address/identify unique target downhole devices and their locations. Further, an autonomous downhole tool can operate to record, assess, and provide positive confirmation of unwanted fluid ingress into a wellbore from a reservoir.

FIG. 1 is a schematic diagram of an example wellbore system 10 that includes one or more adjustable downhole valves 32 and 34 according to the present disclosure. Wellbore system 10 includes a multi-lateral directional wellbore 20 having a vertical portion 22 that extends from a wellhead 14 on a terranean surface 12 through and into one or more subterranean formations 16 and 18 (and others). Subterranean formation 18, in some aspects, represents a hydrocarbon reservoir in which reservoir fluid 36 (for example, oil, gas, water, or a combination thereof) is entrained. Generally, wellbore system 10 can operate to produce the reservoir fluid 36 through the multi-lateral directional wellbore 20 and to the wellhead 14 on the surface 12.

Although not shown in this figure, one or more wellbore casings, such as a surface casing, intermediate casing, and/or production casing can be installed in at least a portion of the wellbore 20 (for example subsequent to completion of the drilling operation or some other time). Other wellbore tubulars, such as a production tubing, liners, or otherwise, can also be included in the wellbore system 10.

In some embodiments, the terranean surface 12 may be an ocean, gulf, sea, or any other body of water under which hydrocarbon-bearing formations may be found. In short, reference to the terranean surface 12 includes both land and water surfaces and contemplates forming and developing one or more wellbore systems 10 from either or both locations.

As shown in this example, the multi-lateral directional wellbore 20 extends from the vertical portion 22 to a horizontal portion 24 (otherwise called a main bore 24) into the subterranean formation 18. A lateral portion 26 (also called a lateral bore 26) also extends from the vertical portion 22 into the subterranean formation 18 uphole of the main bore 25. Each of the main bore 24 and the lateral bore 26 can be operable to produce the reservoir fluid 36, either in parallel or sequentially.

As shown in this example, the main bore 24 includes one or more downhole valves 34 (for example, ICDs or ICVs) that are operable to open or close to allow or prevent the reservoir fluid 36 to enter the wellbore 20 (through main bore 24). Each downhole valve 34, in this example, is installed into a production tubular on which one or more wellbore seals 30 (for example, packers or otherwise) is installed to define one or more compartments. For example, a compartment can be a combination of a downhole valve 34 and two seals 30 (one on either side of the valve 34). Each compartment can represent a fluid flow path from subterranean formation 18 into the wellbore 20 through the downhole valve 34. Further, each compartment can be fluidly isolated within an annulus between the production tubing and casing from adjacent compartments with the wellbore seals 30.

As further shown in this example, the lateral bore 26 includes one or more downhole valves 32 (for example, ICDs or ICVs) that are operable to open or close to allow or prevent the reservoir fluid 36 to enter the wellbore 20 (through lateral bore 26). Each downhole valve 32, in this example, is installed into a production tubular on which one or more wellbore seals 28 (for example, packers or otherwise) is installed to define one or more compartments. For example, a compartment can be a combination of a downhole valve 32 and two seals 28 (one on either side of the valve 32). Each compartment can represent a fluid flow path from subterranean formation 18 into the wellbore 20 through the downhole valve 32. Further, each compartment can be fluidly isolated within an annulus between the production tubing and casing from adjacent compartments with the wellbore seals 28. Although only one lateral bore 26 is shown in the example, there can be more lateral bores 26 that extend from the vertical portion 22 or even no lateral bores 26 that extend from the vertical portion 22 (in other words, a directional well with only main bore 24).

Figure 2A:
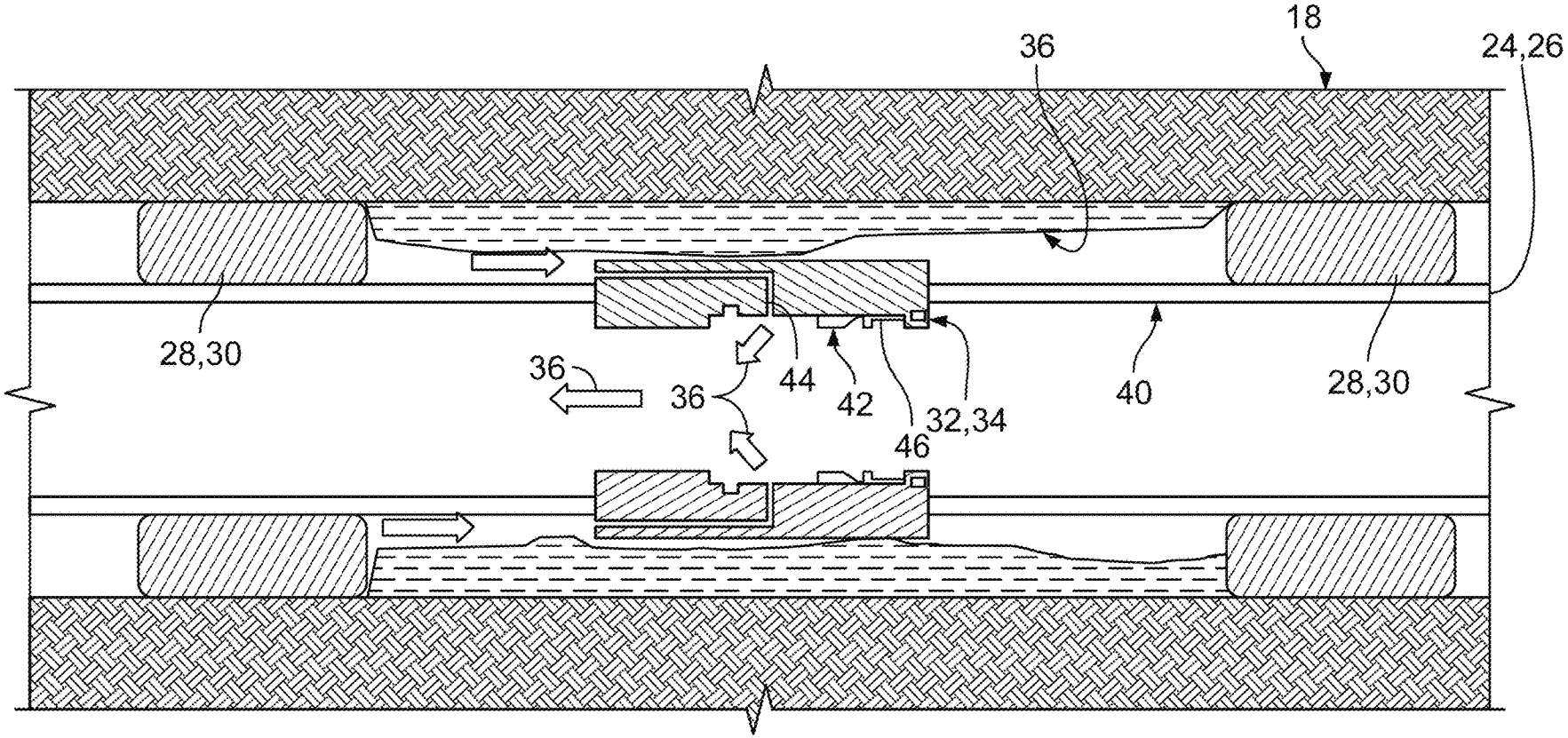
FIGS. 2A and 2B are schematic diagrams of a portion of a wellbore system that includes an adjustable downhole valve according to the present disclosure.
Figure 2B:
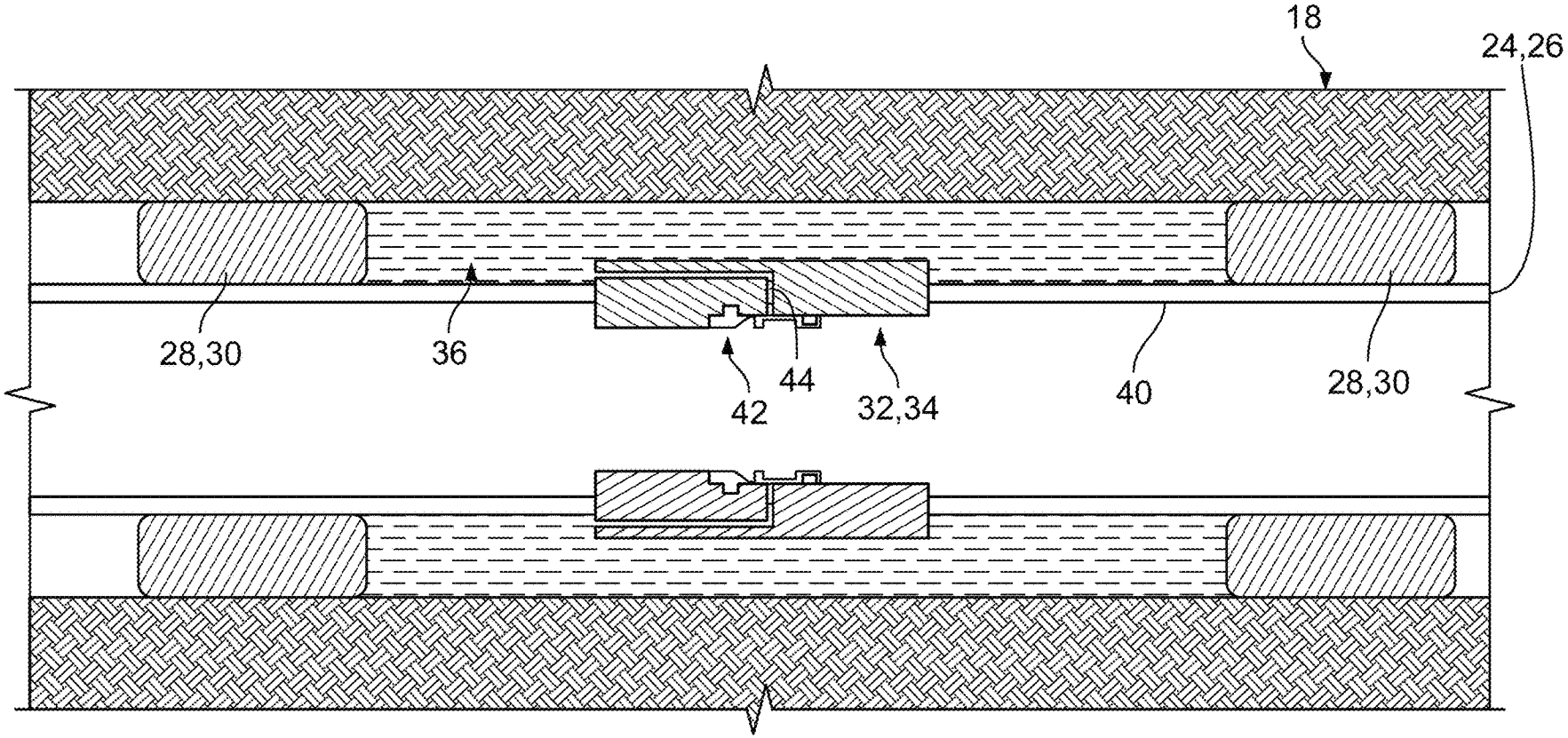

FIGS. 2A and 2B are schematic diagrams of a portion of the wellbore system 10 that includes adjustable downhole valves 32 and/or 34 according to the present disclosure. FIG. 2A shows adjustable downhole valve 32 or 34 installed in a production tubing 40 and in an open position within the subterranean formation 18, which includes reservoir fluid 36. FIG. 2B shows adjustable downhole valve 32 or 34 installed in the production tubing 40 and in a closed position. Generally, according to example implementations of the present disclosure, adjustable downhole valves (such as valves 32 and/or 34) are ICDs or ICVs with shift sleeve positions that use elastomeric seals for closure, and generally have specialized shift profiles combined with a long length of travel. For example, as shown in these figures, adjustable downhole valves 32 and 34 include a shift sleeve 42 that includes a profile 46. In FIG. 2A, the shift sleeve 42 is in an open position in that it exposed a fluid passage 44 that extends through the downhole valve 32 and/or 34. The fluid passage 44 fluidly couples the wellbores 24 and 26 to the subterranean formation 18 so that reservoir fluid 36 can be produced into the production tubing 40.

As shown in FIG. 2A, the shift sleeve 42 is in an open position, which exposes the fluid passage 44 and allows circulation of reservoir fluid 36 into the production tubing 40 from the subterranean formation 18. Wellbore seals 28 and 30 (for example, packers) ride on the production tubing 40 (or are installed thereon) and seal against migration of reservoir fluid 36 along an annulus between the production tubing 40 and the subterranean formation 18 (or a casing, if installed).

In contrast, as shown in FIG. 2B, the shift sleeve 42 is in a closed position, which blocks the fluid passage 44 and prevents (all or most) circulation of reservoir fluid 36 into the production tubing 40 from the subterranean formation 18. As described in more detail herein, an autonomous downhole tool can be operated to shift the shift sleeve 42 between the open and closed positions exclusive of, for instance, downhole conveyances. Further, as described in more detail herein, an autonomous downhole tool can be operated to shift the shift sleeve 42 between the open and closed positions on particular adjustable downhole valves 32 and 34 with a unique addressing process.

Figure 3:
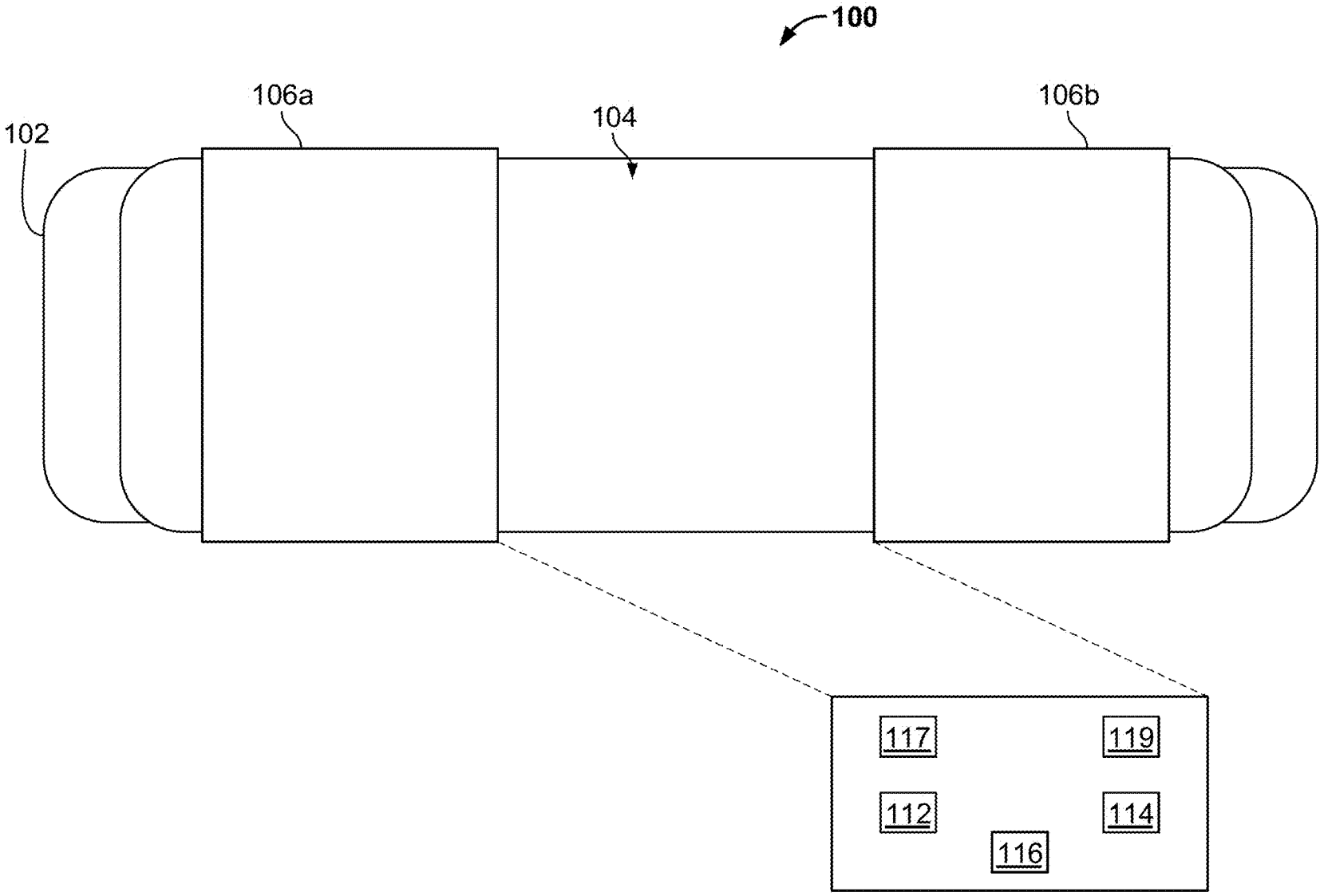
FIG. 3 is a schematic diagram of an example implementation of an autonomous downhole tool operable to adjust a downhole valve according to the present disclosure.

FIG. 3 is a schematic diagram of an example implementation of an autonomous downhole tool 100 operable to adjust a downhole valve according to the present disclosure. In some aspects, the autonomous downhole tool 100 is an untethered tool in that there is no cable or tubing connecting the autonomous downhole tool 100 with the surface. The autonomous downhole tool 100 can carry necessary energy (for example, using batteries or other energy storage devices) needed to complete a downhole operation. In some aspects, the autonomous downhole tool 100 can be substantially neutrally buoyant in that the effective density of the autonomous downhole tool 100, meaning the mass of the autonomous downhole tool 100 divided by its volume, is substantially equal (for example, plus or minus 20%) to the average density of downhole fluids around the autonomous downhole tool 100.

The example implementation of the autonomous downhole tool 100, as shown, includes a pressure housing 104 that at least partially encloses an autonomous carrier 102 and on which rides modular sleeves 106*a* and 106*b*. The pressure housing 104 excludes downhole fluid from an internal gas-filled or vacuum volume. The internal gas-filled or vacuum volume provides buoyancy and optionally contains and protects electronic components and/or batteries that are not able to operate unprotected in the downhole fluids. In some implementations, the pressure housing 104 is substantially cylindrical, at least in the midsection of the autonomous downhole tool 100. Optionally the pressure housing 104 is tapered at the ends of the autonomous downhole tool 100 to facilitate uniform flow of the fluid displaced by the autonomous downhole tool 100 through the annulus between the autonomous downhole tool 100 and the wellbore as the autonomous downhole tool 100 moves. In an implementation, the diameter of the autonomous downhole tool 100 at its midsection is a substantial fraction (25% to 80%) of the smallest diameter in the wellbore, which may be an inner diameter of production tubing, a casing diameter in the case of a cased completion with no tubing, or a diameter of the borehole in the case of a barefoot (uncased) completion. In example implementations, a length of the autonomous downhole tool 100 is at least two times a diameter of the wellbore. This combination of radius and diameter means the autonomous downhole tool 100 may not need to steer, but rather its direction is guided by the wellbore.

Each of the modular sleeves 106*a* and 106*b* can adjust to expose one or more components of the autonomous downhole tool 100. The autonomous carrier 102 can house or enclose one or more control or mechanical components such as, for example, a shifting module (or shift latch) 117 that can mechanically connect with and operate the shift profile 42 of the shift sleeve 46 of downhole valves 32 and 34. The autonomous carrier 102 can house a seal module 119, an actuator module 112, a transmitter module 114, and sensor module 116. The seal module 119, when exposed and activated, can seal against tubing to create a pressure barrier, which can generate a force based on pressure differential direction. The actuator module 112 can create commands to control the modular sleeves 106*a* and 106*b*. The transmitter module 114 ensures that the signals are generated for its target function (for example, locating the position in well) to be received by the receiver which is typically housed in downhole valves 32 and 34. The sensor module 116 is equipped with required onboard diagnostic system that features both hardware and software and allows recording and assessment of various properties of interest inside the wellbore.

Sensor module 116 can measure properties of interest outside the autonomous downhole tool 100 as well as sensors to determine properties of the autonomous downhole tool 100 and a downhole valve (such as downhole valves 32 and 34). In some implementations, sensors for outside the vehicle may include but are not limited to temperature, pressure, fluid flow rate, fluid composition (including chemical composition and/or phase composition, such as water fraction or gas volume fraction), fluid density, fluid viscosity, pipe or wellbore diameter or geometry, corrosion, scale, sand deposits, casing collar detectors, acoustic sensors, and vibration sensors. In some implementations, sensors to determine properties of the autonomous downhole tool 100 can include accelerometers, gyroscopes, magnetometers, attitude sensors, gravity sensors, as well as sensors used for navigation, such as casing collar locators, metal sensors, magnetometers, acoustic sonars, an imaging system, electromagnetic imaging systems, and inductive measurements of conductive objects.

In example operations with the autonomous downhole tool 100, this tool can create a downhole shift force to adjust a downhole valve, such as adjusting a shift sleeve on an ICD/ICV. For creating or generating a shift force downhole, it can be necessary to harness, repurpose or reuse the available energy at the downhole device that is needing to be shifted (in other words, the ICD/ICV). This is fundamentally different from having energy transmitted from the surface such as through hydraulic or electric lines. Several such mechanical systems exist which employ springs, hydraulic leverage chambers, boost piston, etc. to allow for a directed force as a result of well bore generated pressure differential. These force generation systems can be incorporated into the design of the ICDs and ICVs shifting profiles (such as shift sleeve 42 with profile 46) and adjacent features such that they provide the required force of shifting on demand when directed to do so through specific actuation command that deploys the trapped energy. These force generation systems can also be incorporated as a module on the autonomous downhole tool 100 that can be deployed rigless from the surface and navigate intelligently without any contact with the borehole or tubing.

In other example operations with the autonomous downhole tool 100, this tool can actuate and trigger the shift force creation systems in the ICD/ICV. For example, in order to actuate and trigger a trapped energy release or shift force creation mechanism in a downhole valve, a retention system of some kind can be unlocked or undone without using energy transmitted from the surface. To enable this, several existing methods based on quantum, wireless, Bluetooth, RFID, NFC, magnetic, optical, laser or electromagnetic signals among others can be used. This can require a signal polling or broadcast that is generated on demand or by programming at the autonomous carrier 102 that houses the transmitter 114 and actuates a target system on the ICD/ICV, which is equipped with a receiver. The power to enable these signal processing and relay is delivered through an onboard battery or in-situ power generation of the autonomous downhole tool 100, which harnesses the potential or kinetic energy of the autonomous downhole tool 100 and its surroundings during the travel.

In other example operations with the autonomous downhole tool 100, this tool can convey or carry the actuator system (as actuator module 112) to a target location in a wellbore. For instance, to enable wireless and automated downhole shifting, it may be required to carry the actuator module 112 to a target downhole valve (ICD or ICV). This module 112 can be fitted onto a powered autonomous intelligent device with on board sensors, and pre-programmable guidance, collision detection and navigation systems, including self-centralization functionality. These devices can be, for example, a tractor, bot, dart, ball, or generally cylindrical modules and can be sentient or AI augmented as described in U.S. patent application Ser. No. 18/910,946.

In other example operations with the autonomous downhole tool 100, this tool can address/identify unique target downhole devices (for example, ICDs/ICVs) and their locations in a wellbore. For example, to perform untethered selective contingency shifting of an ICD or ICV sleeve (such as shift sleeve 42), it can be necessary to accurately locate, orient the actuator module 112 in the actionable vicinity of the target device sleeve within the complex well architecture with multiple lateral bores and zonal segments, which include a multitude of installed ICDs and ICVs (for example, as shown in wellbore system 10). This actuator module 112 is disposably appended to the autonomous carrier 102. This operation can be enabled through embedding specific identity tags in the target device sleeves which can be autonomously recognized through unique addresses through a continuously interrogating signal broadcast polling from the actuator module 112. Address tags and unique identifiers can be incorporated within the target flow control device (ICD or ICV) to allow for faster zeroing in on coordinates in the wellbore.

Figure 4:
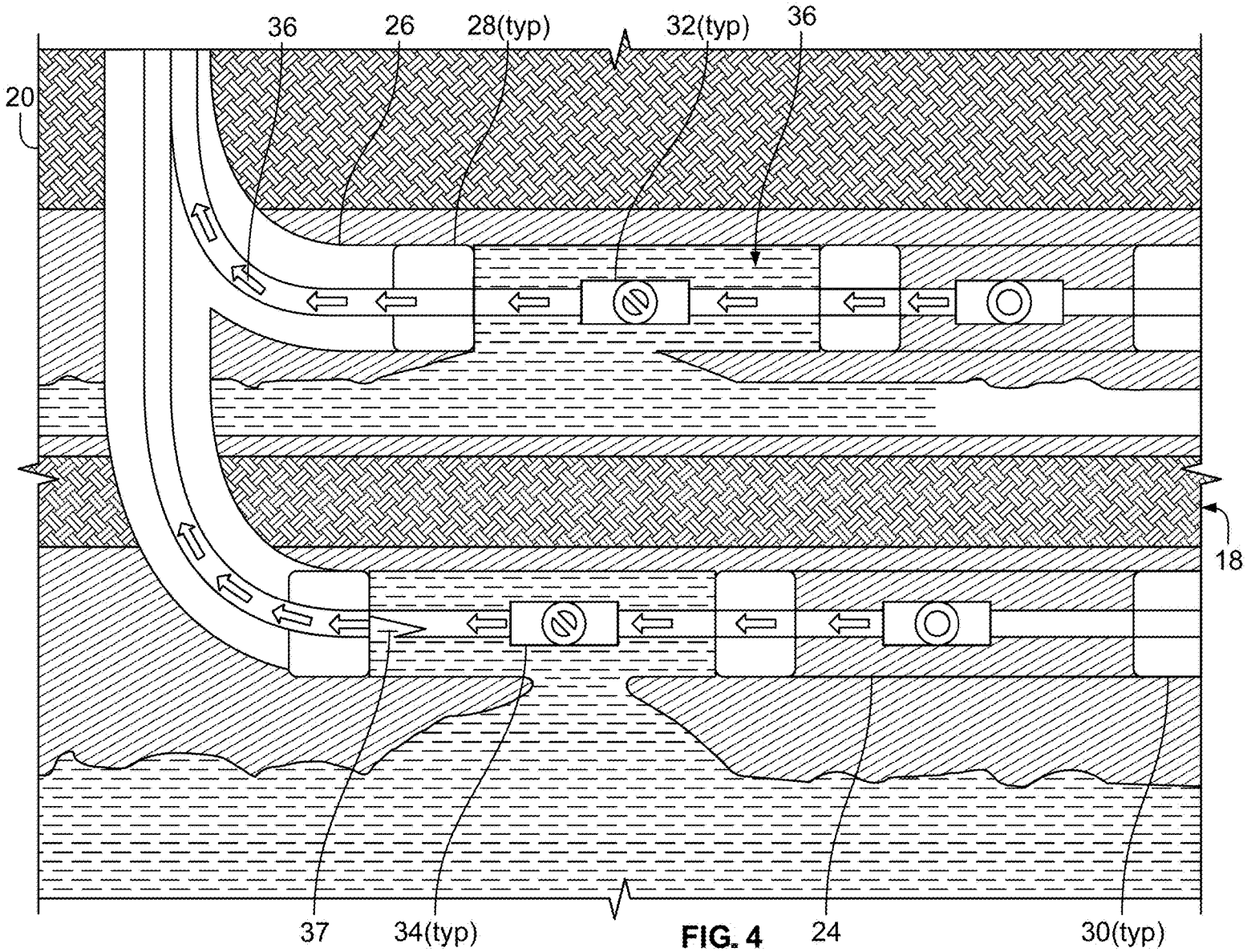
FIG. 4 is a schematic diagram of a portion of a production well that includes a main wellbore and lateral wellbore with one or more downhole valves according to the present disclosure.

In other example operations with the autonomous downhole tool 100, this tool can record, assess and provide positive confirmation of unwanted fluid ingress. For example, FIG. 4 is a schematic diagram of a portion of the production well 20 that includes the main wellbore 24 and lateral wellbore 26 with one or more downhole valves 32 and 34. This figure shows a situation in which water ingress 37 has infiltrated the main bore 24. Verification assurance of conducted operations is crucial in determining if a planned job by the autonomous downhole tool 100 was successful and if the operation goals were met. When the intent/objective is to control unwanted fluid ingress from zones in a wellbore, it can be necessary to ascertain condition and operating position of flow control equipment such as ICDs and ICVs, zonal isolation packers along with tool string and tubulars in the vicinity of the target zone producing the unwanted fluids (as shown in FIG. 4). The example implementation of the autonomous downhole tool 100 can include a power conscious verification module (in the form of sensor module 116) that can be (optionally) disposably appended to the autonomous carrier 102 with different operating modes, such as on/off/sleep/wakeup etc. The sensor module 116 can be equipped with required onboard diagnostic system that features both hardware and software and allows recording and assessment through sonic, resistivity, capacitance, magnetic, conductance, position sensing linear variable displacement transducer, photographic means among others.

In a more specific example operation of the autonomous downhole tool 100, this tool can be used to stop or help control unwanted fluid production, such as unwanted water production, when other components of the wellbore system (such as the ICDs/ICVs) fail or otherwise do not stop or control such fluid production. For example, prior to introducing the autonomous downhole tool 100 into the production well 20, a well operator can review unwanted fluids production and identify one or more target zones in which the fluid production is occurring. The particular ICDs/ICVs in such one or more target zones are identified. Next, the autonomous downhole tool 100 can be programmed (for example, the autonomous carrier module 102). The autonomous downhole tool 100 can be equipped (for example, at the surface 12) with a smart modular carrier for performing downhole ICD/ICV shifting. The carrier 102 can be input with shifting and addressing programs, as well as recording (by sensor module 116, for instance) and validation programs.

Next, the autonomous downhole tool 100 can be deployed into production well 20. For example, the well 20 can be shut in and wellhead 14 can be opened. The autonomous downhole tool 100 can be released into the wellbore 20 and travel to pre-programmed locations of the identified ICDs/ICVs in the one or more target zones. Next, the autonomous downhole tool 100 can execute the loaded shifting program on the carrier module 102. For example, shift sleeves of the identified ICDs/ICVs can be adjusted per program commands. The autonomous downhole tool 100 can record positive confirmation data (of the shifting) from the target zones.

Next, the autonomous downhole tool 100 can be retrieved from the production well 20. For example, the autonomous downhole tool 100 can return to the wellhead 14 (for example, by naturally buoyancy, propulsion, fluid circulation, or otherwise). The autonomous downhole tool 100 can be inspected and data from the autonomous downhole tool 100 (for example, transmitter 114) can be downloaded so that further operations decisions can be made.

Figure 5A:
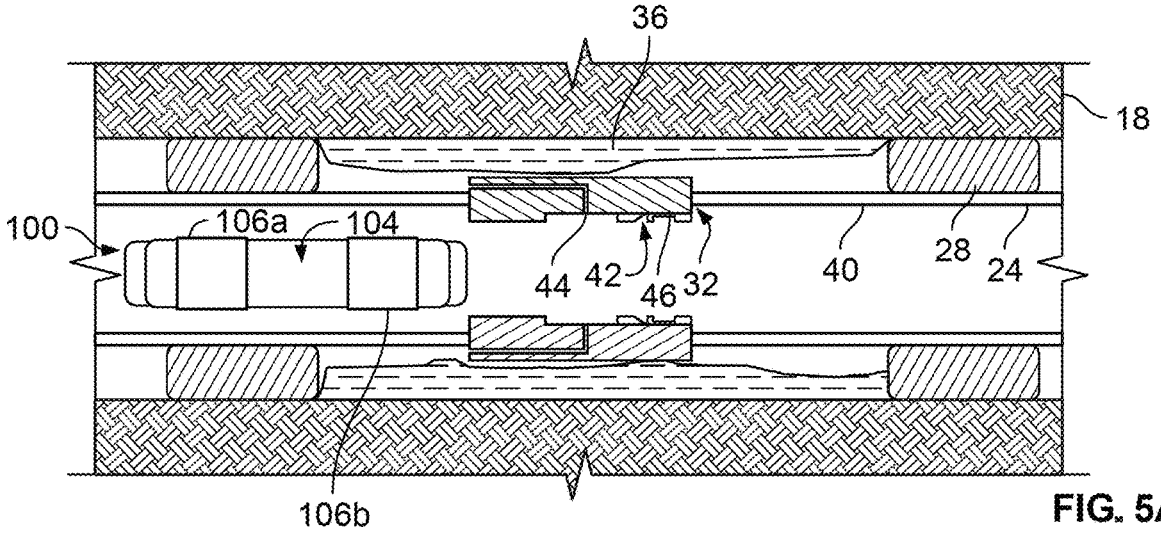
FIGS. 5A-5L are schematic diagrams that illustrate an example process for adjusting a downhole valve with an autonomous downhole tool according to the present disclosure.
Figure 5B:
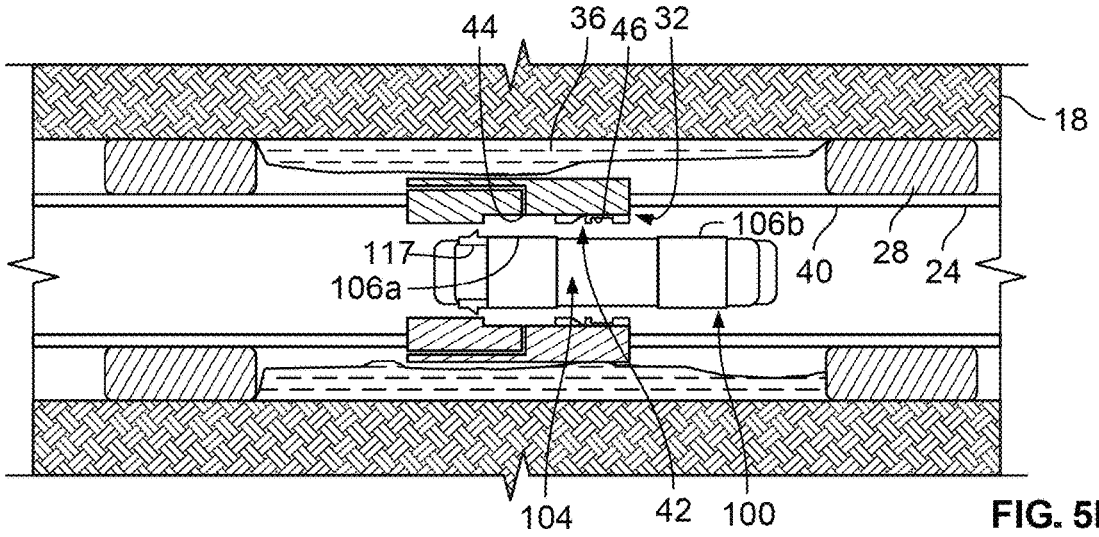

FIGS. 5A-5L are schematic diagrams that illustrate an example process for adjusting a downhole valve with the autonomous downhole tool 100 according to the present disclosure. More particularly, these figures represent an example implementation of a shifting process performed by the autonomous downhole tool 100 on an ICD or ICV (for example, downhole valve 32 or 34) once identified as described previously. FIG. 5A shows the autonomous downhole tool 100 approaching a target location (in this example, in main bore 24). The target location, in this example, is a particular downhole valve 32 installed in the production tubing 40 within a particular target zone. FIG. 5B shows the autonomous downhole tool 100 at the downhole valve 32 with the modular sleeve 106*a* activated to reveal a shift latch 117 that is formed on rides on the housing 104 of the autonomous downhole tool 100.

Figure 5C:
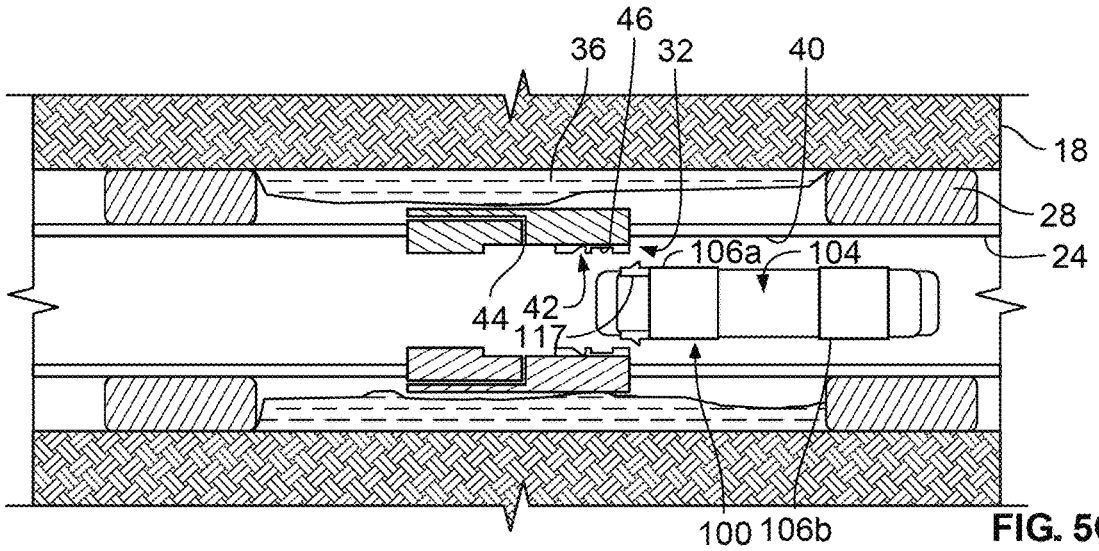
Figure 5D:
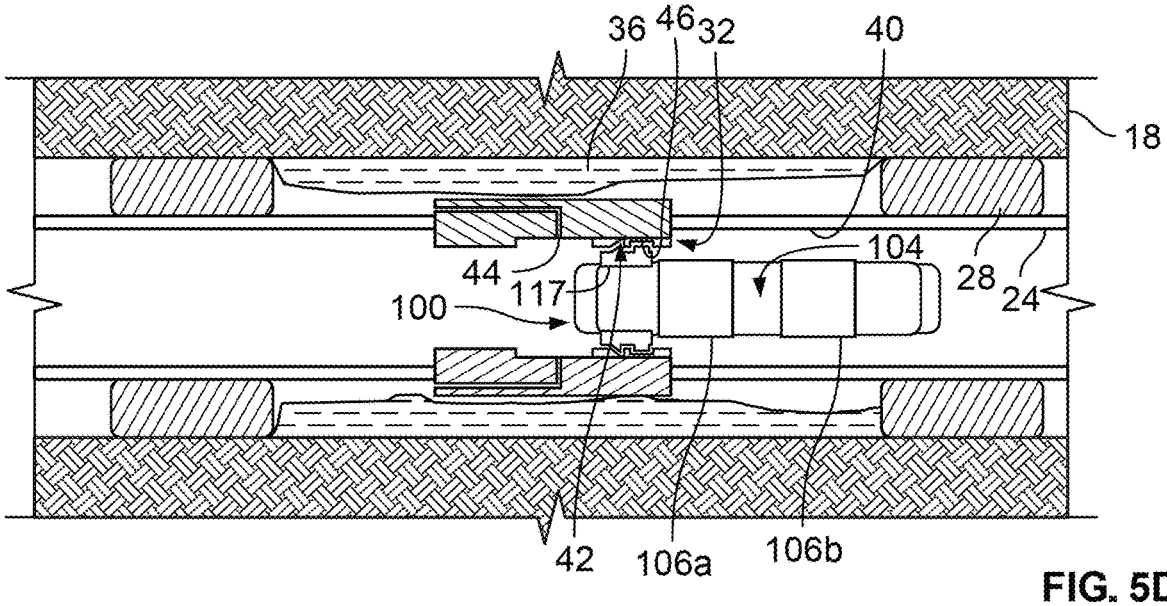

Continuing at FIG. 5C, this figure shows the autonomous downhole tool 100 adjusting its location and orientation in the main bore 24 adjacent the shift sleeve 42 of the downhole valve 32. Next, FIG. 5D shows the autonomous downhole tool 100 engaged with the downhole valve 32. More specifically, the shift latch 117 of the autonomous downhole tool 100 is engaged (mechanically coupled to) the profile 46 of the shift sleeve 42. Thus, in this example, the shift latch 117 has a shape that matches the profile 46 to provide the contacting engagement as shown.

Figure 5E:
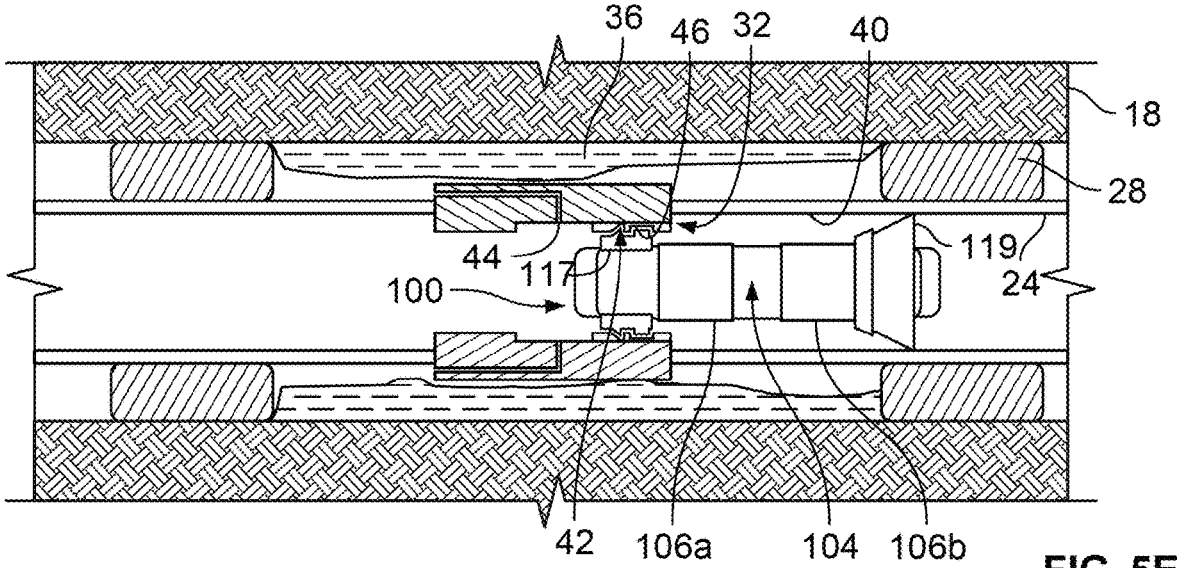
Figure 5F:
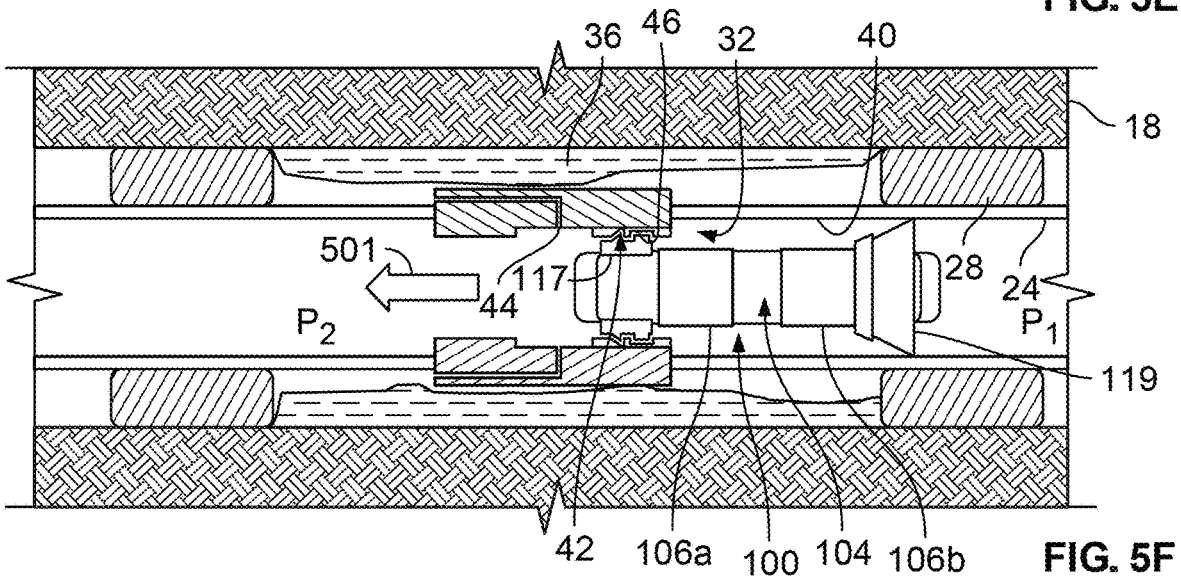

FIG. 5E shows the autonomous downhole tool 100 with a tubing seal 119 exposed by activating the modular sleeves 106*b*. Meanwhile, the autonomous downhole tool 100 is anchored to the shift sleeve 42 preventing any relative motion. The tubing seal 119, when exposed by the modular sleeve 106*b*, engages the production tubing 40, thereby creating a seal against the tubing area separating the pressure above and below the seal point. Through manipulation of pressure above the seal (for example, from surface), the tubing seal 119 thereby creates a differential pressure on the autonomous downhole tool 100 (for example, due to fluid gradient in the main bore 24). The differential pressure generates a shift force 501, shown in FIG. 5F. In FIG. 5F, the shift force 501 is generated due to a pressure differential between P1 and P2 on opposing ends of the autonomous downhole tool 100, P1 being pressure below the sealing point and P2, above the sealing point. The direction of the force is dictated by the positive pressure differential. In this instance, P1 is greater than P2 and the arrow of force is shown uphole, thereby the shifting force moves the shift sleeve 42 to the uphole direction to close the fluid passage 44.

Figure 5G:
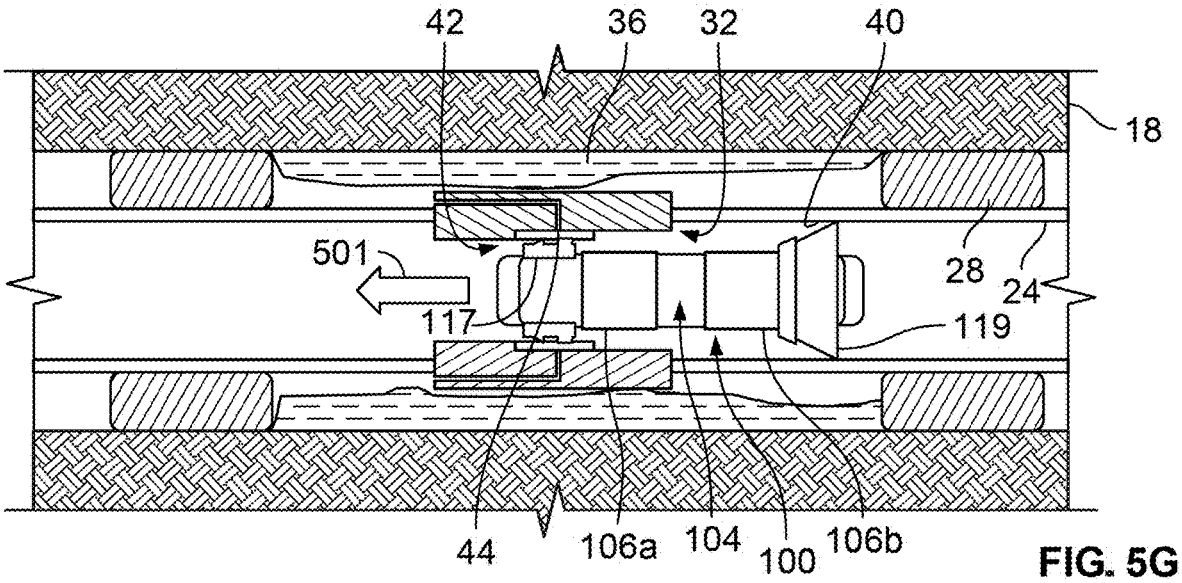
Figure 5H:
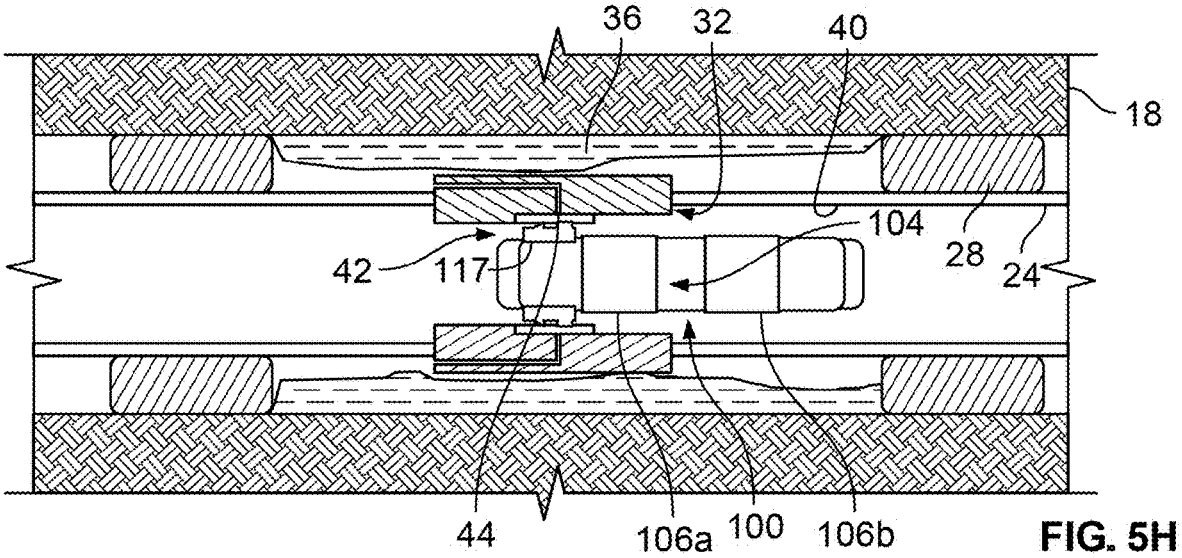
Figure 5I:
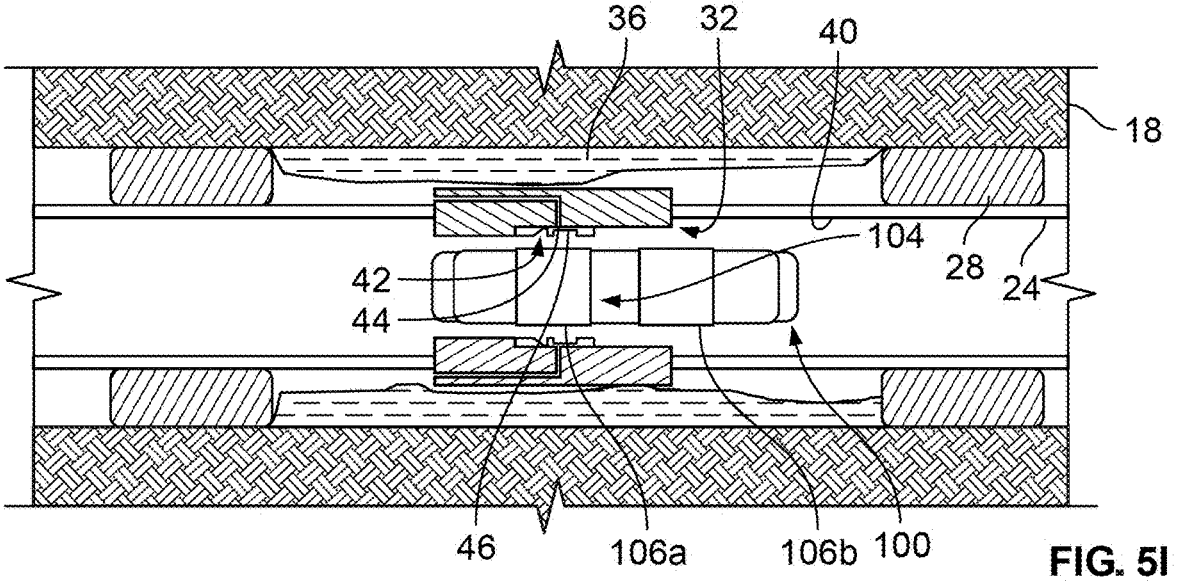
Figure 5J:
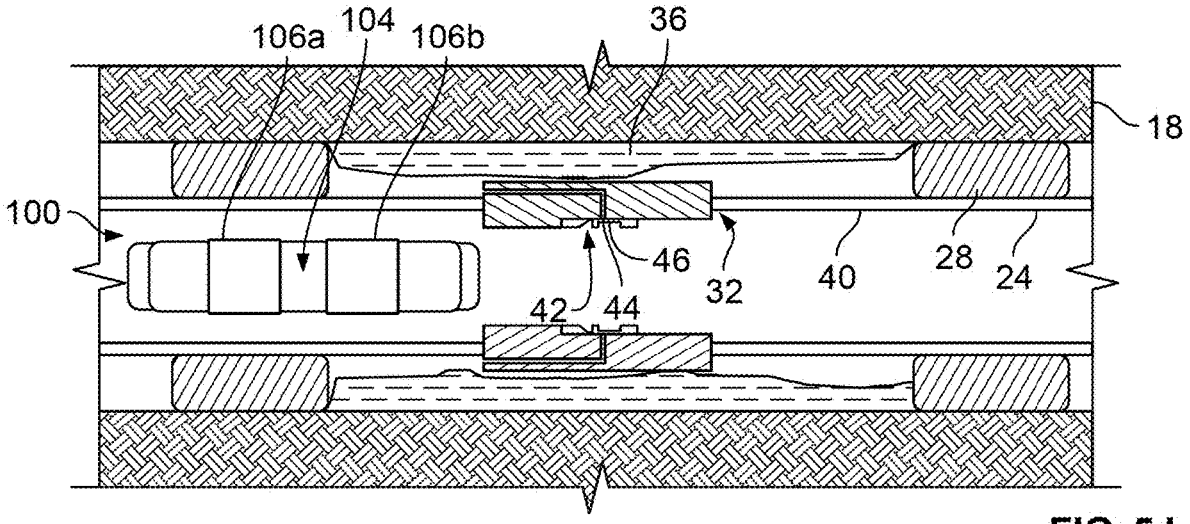
Figure 5K:
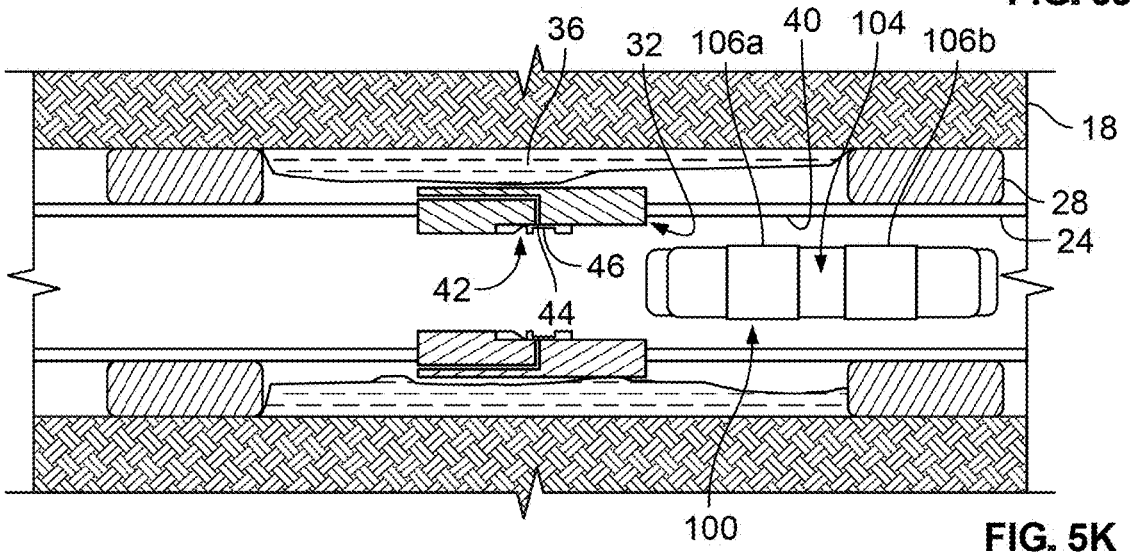
Figure 5L:
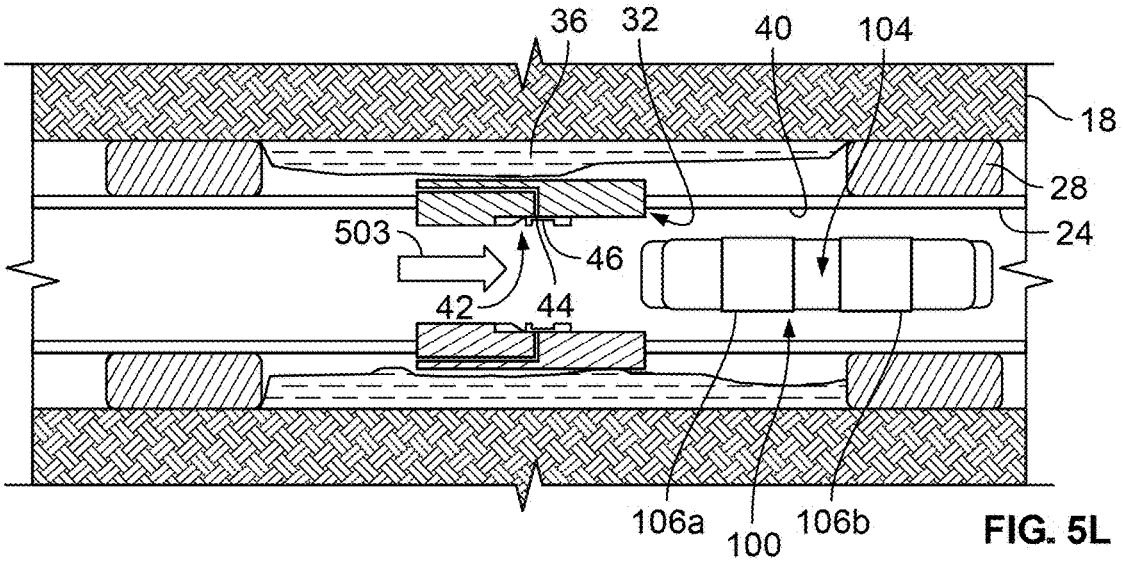

Continuing at FIG. 5G, this figures shows shift force 501 urging the autonomous downhole tool 100 to move the shift sleeve 42 over the fluid passage 44, thereby adjusting the downhole valve 32 from an open position to a closed position. In FIG. 5H, the tubing seal 119 is retracted or otherwise deactivated by the modular sleeve 106*b*. The autonomous downhole tool 100, at this step (or other step) can confirm and record a positive indication of sleeve closure for the downhole valve 32 (for example, with sensor module 116). In FIG. 5I, the shift latch 117 is retracted or otherwise deactivated by the modular sleeve 106*a*. As this valve closure operation is completed, the autonomous downhole tool 100 can investigate the target zone and its vicinity and record any anomalies in FIGS. 5J and 5K (moving to either side or both sides of the particular downhole valve 32). In FIG. 5L, the autonomous downhole tool 100 travels (for example, under propulsion 503 or fluid movement 503) to another programmed (for example, with actuator module 112) operation (or to the surface in all operations are completed).

Figure 6A:
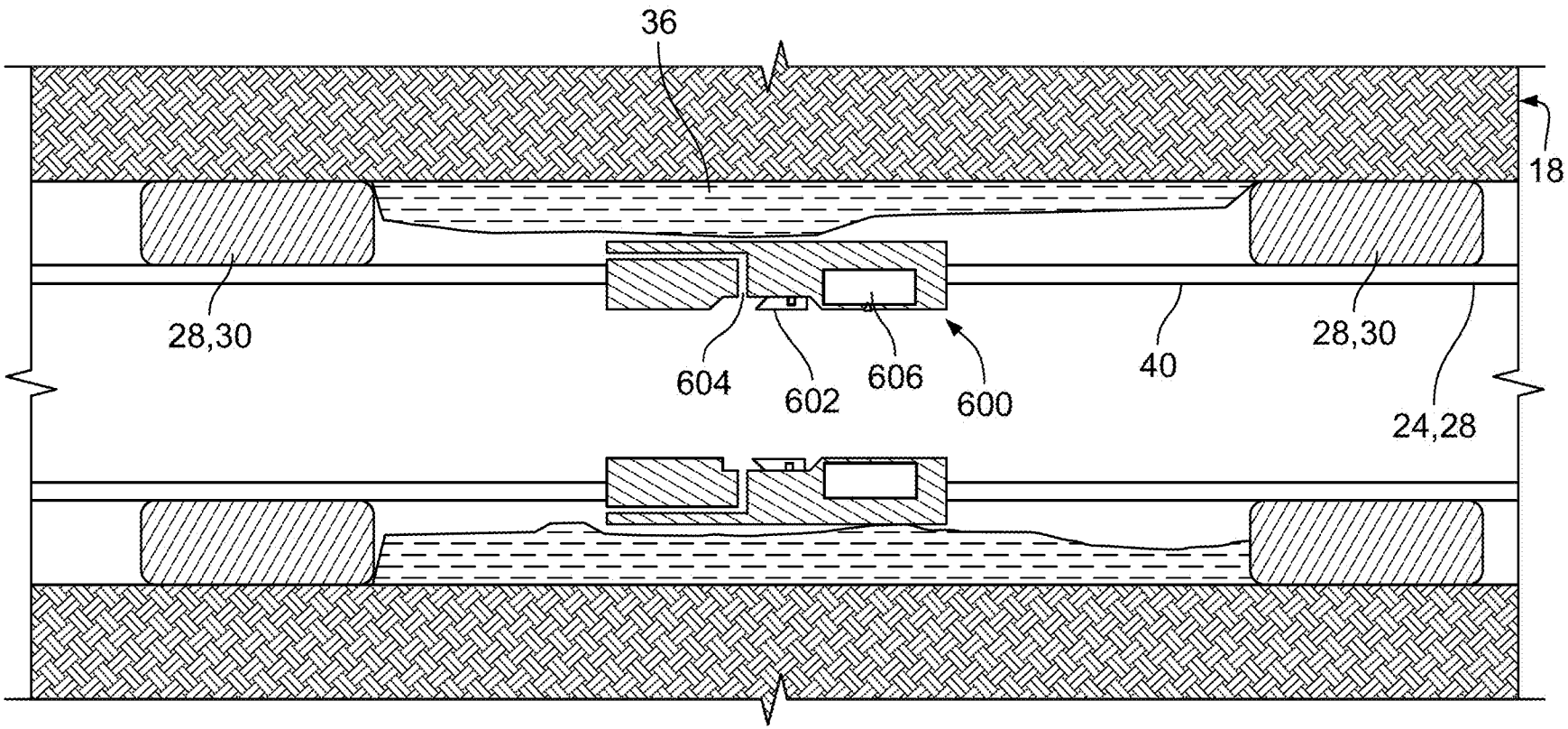
FIGS. 6A-6F are schematic diagrams that illustrate another example process for adjusting a downhole valve with an autonomous downhole tool according to the present disclosure.

FIGS. 6A-6F are schematic diagrams that illustrate another example process for adjusting a downhole valve with the autonomous downhole tool 100 according to the present disclosure. For example, FIG. 6A shows an implementation of the wellbore system 10 in which a downhole valve 600 is installed in the production tubing 40. The downhole valve 600 includes an optimized universal shift profile (used in ICDs and ICVs) where a linear length of shift is optimized around the ports. The downhole valve 600 incorporates a scale and debris resistant design and employs metal-to-metal seals for sealing. The downhole valve 600 incorporates an in situ force generation systems. In some aspects, the downhole valve 600 can have increased reliability when the closure mechanism lays dormant for a very long time which is generally expected in the time frame for a contingency shift. As shown, the downhole valve 600 includes a shift sleeve 602 that can move to cover a fluid passage 604 and seal with a metal-to-metal seal to put the downhole valve 600 into a closed position. The shift sleeve 602 can also move to expose the fluid passage 604 to put the downhole valve 600 into an open position.

In this example, the shift sleeve 602 can be activated by an activator tag 606 housed or enclosed within the downhole valve 600. The activator tag 606 can receive wireless communications (for example, RF, Bluetooth, etc.) from the autonomous downhole tool 100; such communications can be commands to the activator tag 606 to activate the shift sleeve 602 to move to either place the downhole valve 600 into the open position or the closed position.

Figure 6B:
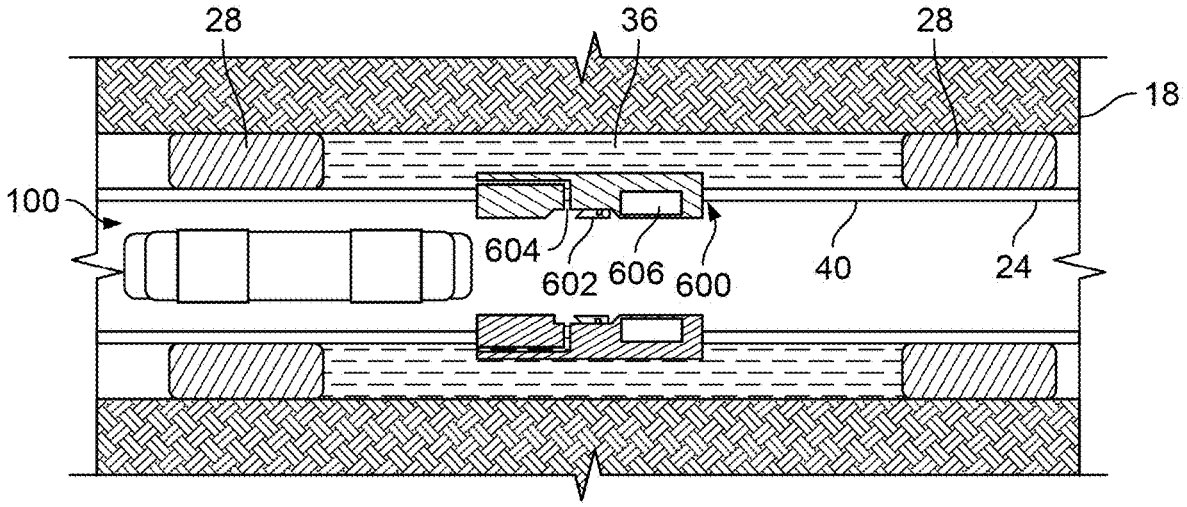

FIGS. 6B-6F show a process of adjusting the downhole valve 600 with the autonomous downhole tool 100. As shown, FIG. 6B illustrates the autonomous downhole tool 100 approaching the downhole valve 600. In this example, the downhole valve 600 can include or be defined within the wellbore system 10 with a unique addressable signal. In other words, each downhole valve 600 within the main bore 24 (or lateral bore 26) can have its own unique address that defines, for example, its location within the particular bore. This unique address can be transmitted externally from the downhole valve 600 by, for example, the activator tag 606. Thus, as the autonomous downhole tool 100 moves through, for instance, the main bore 24, the downhole valve 600 can be transmitting its unique address within the main bore 24. The autonomous downhole tool 100 can receive such signal as it moves into the vicinity (for example, within yards, feet) of the downhole valve 600. Further, the autonomous downhole tool 100 can be programmed (for example, with the actuator module 112) to seek out and move to a particular address location defined by the downhole valve 600.

Figure 6C:
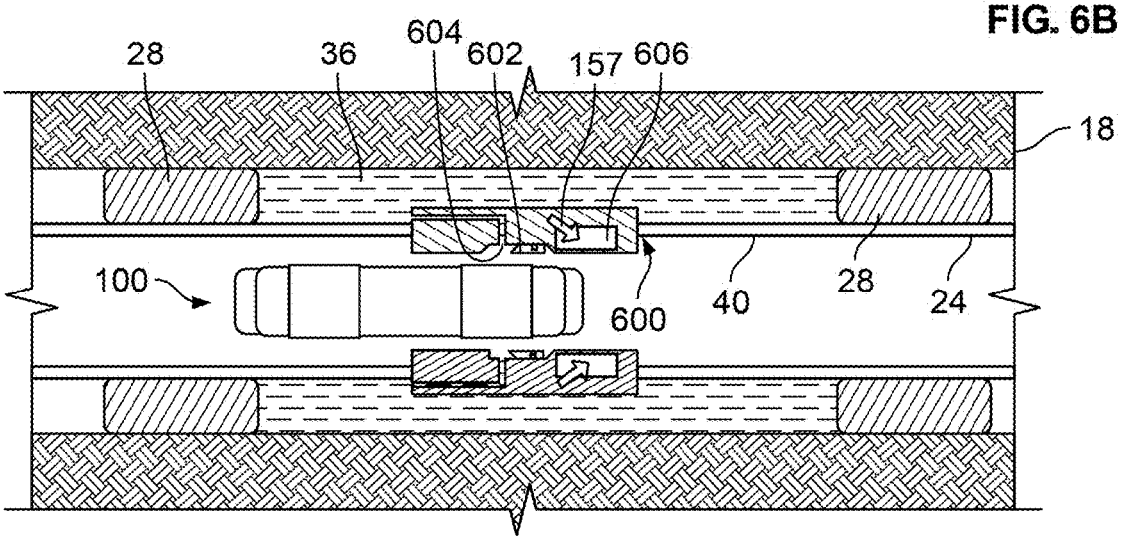
Figure 6D:
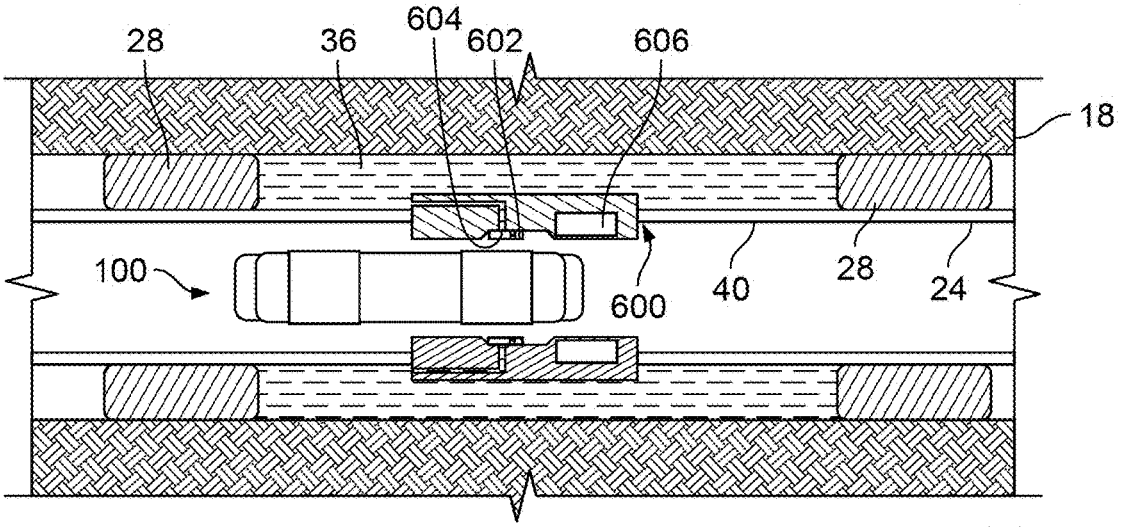
Figure 6E:
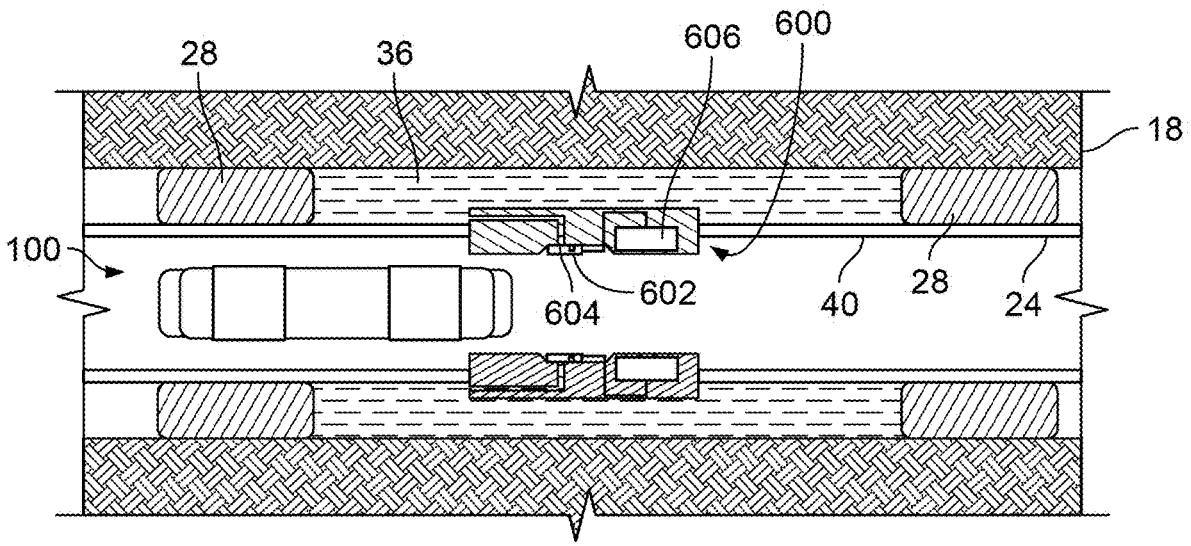
Figure 6F:
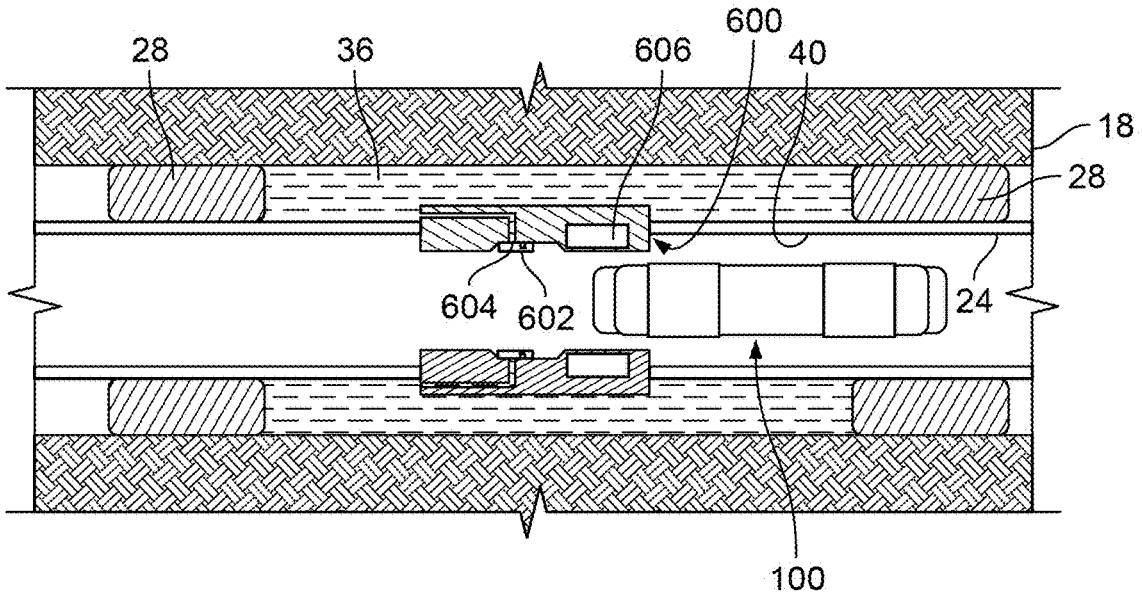

In FIG. 6C, the autonomous downhole tool 100 transmits a signal 152 to the activator tag 606 to activate an in-situ force generator. As shown in FIG. 6D, the in-situ force generator of the downhole valve 600 urges the shift sleeve 602 into the closed position, for instance, through the released energy from the force generation system of the valve 600. In the step of FIG. 6D, the autonomous downhole tool 100 can confirm and record a positive indication of the closure of the downhole valve 600 due to movement of the shift sleeve 602 (for example, with sensor module 116). As this valve closure operation is completed, the autonomous downhole tool 100 can investigate the target zone and its vicinity and record any anomalies in FIG. 6E (moving to either side or both sides of the particular downhole valve 600). In FIG. 6F, the autonomous downhole tool 100 travels (for example, under propulsion or fluid movement) to another programmed operation (or to the surface in all operations are completed).

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. An autonomous downhole tool, comprising:

a housing comprising one or more modular sleeves that ride on the housing, the one or more modular sleeves comprising a first modular sleeve that rides on the housing and is configured to adjust to conceal or expose a shift latch that comprises a latch profile, the latch profile shaped to interface with a shift sleeve profile of a shift sleeve of a downhole valve installed in a wellbore tubular that extends through a wellbore formed from a terranean surface into a subterranean formation, the one or more modular sleeves comprising a second modular sleeve that rides on the housing and is configured to adjust to conceal or expose a tubing seal from the housing, the tubing seal configured to engage the wellbore tubular to maintain the housing at a stationary location in the wellbore; and an autonomous carrier coupled with the housing and comprising an actuator module configured to generate a shift force to adjust the shift sleeve on the downhole valve with the shift latch engaged with the shift sleeve through mechanical engagement of the latch profile with the shift sleeve profile.

2. The autonomous downhole tool of claim 1, wherein the housing comprises an untethered housing configured to move through the wellbore exclusive of a downhole conveyance that extends through the wellbore from the terranean surface to the housing.

3. The autonomous downhole tool of claim 2, wherein the tubing seal is configured to generate a pressure differential on the housing when engaged with the wellbore tubular to generate the shift force.

4. The autonomous downhole tool of claim 2, wherein the autonomous carrier comprises a sensor module configured to detect and confirm the adjustment of the shift sleeve on the downhole valve.

5. The autonomous downhole tool of claim 4, wherein the actuator module comprises one or more pre-programmed wellbore locations, each of the one or more pre-programmed wellbore locations comprising a unique downhole valve installed in the wellbore tubular.

6. The autonomous downhole tool of claim 5, wherein the wellbore tubular comprises production tubing, and the downhole valve comprises an inflow control device or inflow control valve.

7. The autonomous downhole tool of claim 1, wherein the tubing seal is configured to generate a pressure differential on the housing when engaged with the wellbore tubular to generate the shift force.

8. The autonomous downhole tool of claim 7, wherein the housing comprises an untethered housing configured to move through the wellbore exclusive of a downhole conveyance that extends through the wellbore from the terranean surface to the housing.

9. The autonomous downhole tool of claim 1, wherein the autonomous carrier comprises a sensor module configured to detect and confirm the adjustment of the shift sleeve on the downhole valve.

10. The autonomous downhole tool of claim 1, wherein the actuator module comprises one or more pre-programmed wellbore locations, each of the one or more pre-programmed wellbore locations comprising a unique downhole valve installed in the wellbore tubular.

11. The autonomous downhole tool of claim 1, wherein the wellbore tubular comprises production tubing, and the downhole valve comprises an inflow control device or inflow control valve.

12. The autonomous downhole tool of claim 1, wherein:

the autonomous carrier comprises a sensor module configured to detect and confirm the adjustment of the shift sleeve on the downhole valve, the actuator module comprises one or more pre-programmed wellbore locations, each of the one or more pre-programmed wellbore locations comprising a unique downhole valve installed in the wellbore tubular, and the wellbore tubular comprises production tubing, and the downhole valve comprises an inflow control device or inflow control valve.

13. A method of operating a downhole valve, comprising:

running an autonomous downhole tool into a wellbore tubular that extends through a wellbore formed from a terranean surface into a subterranean formation, the autonomous downhole tool comprising:

a housing comprising one or more modular sleeves that ride on the housing; and an autonomous carrier coupled with the housing and comprising an actuator module;

moving the autonomous downhole tool to a particular location in the wellbore tubular at which a downhole valve is installed;

adjusting a first modular sleeve of the one or more modular sleeves to expose a shift latch, the shift latch comprising a latch profile shaped to interface with a shift sleeve profile of a shift sleeve of the downhole valve;

engaging the latch profile of the shift latch with the shift sleeve profile of the shift sleeve;

generating a shift force to adjust the shift sleeve on the downhole valve with the shift latch engaged with the shift sleeve;

adjusting a second modular sleeve of the one or more modular sleeves to expose a tubing seal from the housing; and engaging the wellbore tubular with the tubing seal to maintain the housing at a stationary location in the wellbore.

14. The method of claim 13, wherein moving the autonomous downhole tool comprises moving the housing through the wellbore exclusive of a downhole conveyance that extends through the wellbore from the terranean surface to the housing.

15. The method of claim 14, comprising generating a pressure differential on the housing in response to engaging the tubing seal with the wellbore tubular to generate the shift force.

16. The method of claim 14, comprising detecting and confirming the adjustment of the shift sleeve on the downhole valve with a sensor module of the autonomous downhole tool.

17. The method of claim 16, comprising moving the autonomous downhole tool to one or more pre-programmed wellbore locations subsequent to detecting and confirming the adjustment of the shift sleeve on the downhole valve with the sensor module of the autonomous downhole tool.

18. The method of claim 17, wherein the wellbore tubular comprises production tubing, and the downhole valve comprises an inflow control device or inflow control valve.

19. The method of claim 13, comprising generating a pressure differential on the housing in response to engaging the tubing seal with the wellbore tubular to generate the shift force.

20. The method of claim 19, wherein moving the autonomous downhole tool comprises moving the housing through the wellbore exclusive of a downhole conveyance that extends through the wellbore from the terranean surface to the housing.

21. The method of claim 13, comprising detecting and confirming the adjustment of the shift sleeve on the downhole valve with a sensor module of the autonomous downhole tool.

22. The method of claim 21, comprising moving the autonomous downhole tool to one or more pre-programmed wellbore locations subsequent to detecting and confirming the adjustment of the shift sleeve on the downhole valve with the sensor module of the autonomous downhole tool.

23. The method of claim 13, wherein the wellbore tubular comprises production tubing, and the downhole valve comprises an inflow control device or inflow control valve.

24. The method of claim 13, wherein the wellbore tubular comprises production tubing, and the downhole valve comprises an inflow control device or inflow control valve, the method comprising:

detecting and confirming the adjustment of the shift sleeve on the downhole valve with a sensor module of the autonomous downhole tool; and moving the autonomous downhole tool to one or more pre-programmed wellbore locations subsequent to detecting and confirming the adjustment of the shift sleeve on the downhole valve with the sensor module of the autonomous downhole tool.

* * * * *